United States Patent [19]

Ewig

[11] 4,133,468

[45] Jan. 9, 1979

[54] STAPLER

[75] Inventor: John F. Ewig, Worcester, Mass.

[73] Assignee: Parker Manufacturing Company, Worcester, Mass.

[21] Appl. No.: 844,584

[22] Filed: Oct. 25, 1977

[51] Int. Cl.[2] ..... B25C 5/06
[52] U.S. Cl. ..... 227/126
[58] Field of Search ..... 227/125, 126, 127

[56] References Cited

U.S. PATENT DOCUMENTS

| | | | |
|---|---|---|---|
| 2,268,102 | 12/1941 | Attula | 227/126 |
| 3,149,339 | 9/1964 | Johnson | 229/126 |
| 3,862,712 | 1/1975 | La Pointe et al. | 227/127 |

*Primary Examiner*—Roy Lake
*Assistant Examiner*—Paul A. Bell
*Attorney, Agent, or Firm*—Norman S. Blodgett; Gerry A. Blodgett

[57] ABSTRACT

Stapler having a staple track locked in the base by means of a resilient plastic latch.

8 Claims, 5 Drawing Figures

STAPLER

BACKGROUND OF THE INVENTION

It is common practice in the design of stapling guns to provide a staple magazine which can be removed from the base of the stapler and in which a new supply of staples can be placed before it is re-inserted. In order to maintain the magazine and the supply of staples in place, it has been the practice in the past to provide a somewhat complex latch. Such a latch is shown in the patent of LaPointe, U.S. Pat. No. 3,862,712. Because of its nature, it is necessary to make the latching mechanism in several parts, which parts have a tendency to clog, particularly in the dusty working conditions that are encountered in construction work. Furthermore, there is a tendency for the latch action to bind because of its intricate nature. These and other difficulties experienced with the prior art devices have been obviated in a novel manner by the present invention.

It is, therefore, an outstanding object of the invention to provide a stapler having a one-piece staple magazine latch.

Another object of this invention is the provision of a stapler whose construction is simple in nature, so that it is easy to assemble and to use.

A further object of the present invention is the provision of a stapler in which the staple magazine latch is designed as a one-piece resilient plastic injection molding, thus having no parts that can become inoperative or which can bind during use.

It is another object of the instant invention to provide a stapler in which several of the operative elements are accurately and inexpensively formed from plastic by the injection molding process.

With these and other objects in view, as will be apparent to those skilled in the art, the invention resides in the combination of parts set forth in the specification and covered by the claims appended hereto.

SUMMARY OF THE INVENTION

In general, the invention consists of a stapler having a main housing with a grip handle and an operating handle extending therefrom. An elongated compartment underlies the main housing and extends in the same general direction as the grip handle. A staple magazine including a track is slidable in and out of an opening in the compartment and has a pusher slidably mounted in the track. A latch formed of a bendable plastic is mounted in the staple track adjacent the opening in the compartment. The compartment has an upper horizontal wall with an aperture formed in it and the latch has a finger that normally resides in the aperture to prevent the magazine from leaving the compartment. The latch has an elongated leg which extends lengthwise of the staple track and has a laterally-extending peg adjacent its free end that lies in an aperture formed in a side wall of the track.

More specifically, the peg and the aperture have the same non-circular shape that is elongated in the direction of the length of the track. The latch is also formed with an integral leaf spring that engages a bottom wall of the track and biases the finger upwardly into the aperture.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
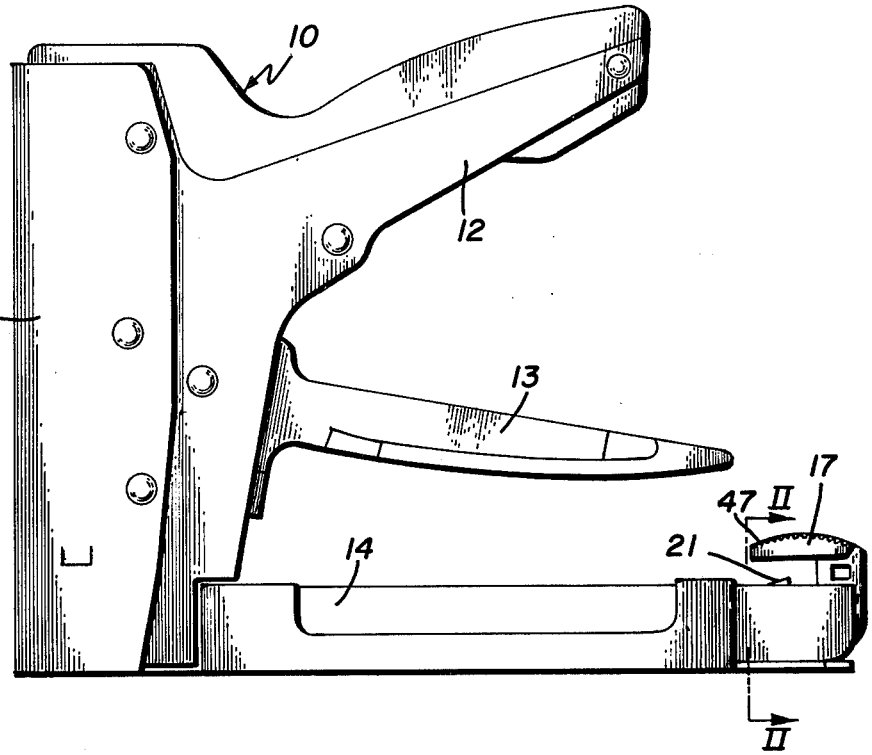
FIG. 1 is a front elevational view of a stapler embodying the principles of the present invention.

Referring first to FIG. 1, wherein are best shown the general features of the invention, the stapler, indicated generally by the reference numeral 10, is shown as having a main housing 11 with a grip handle 12 extending generally at a slight angle above the horizontal in the upper portion thereof. An operating handle 13 underlies the grip handle. The grip handle is formed as a pistol grip and the stapler is operated by squeezing the operating handle 13 in the manner of a trigger. An elongated compartment 14 underlies the main housing and extends in the same general direction as the grip handle 12 and the operating handle 13. A magazine including a staple track 15 (FIG. 3) is slidable in and out of an opening at the right-hand end of the compartment and a pusher 16 is slidably mounted on the track. A latch 17 formed of a bendable plastic is mounted in the staple track adjacent the opening in the compartment.

Figure 2:
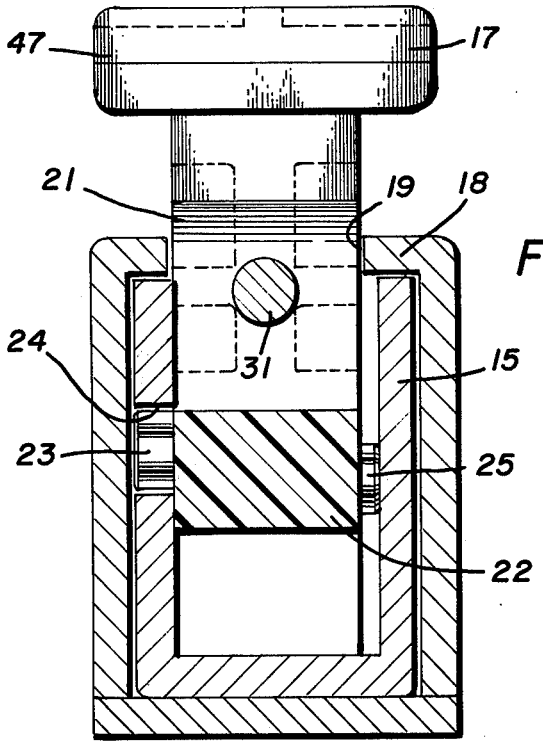
FIG. 2 is a transverse sectional view of the stapler taken on the line II—II of FIG. 1.
Figure 3:
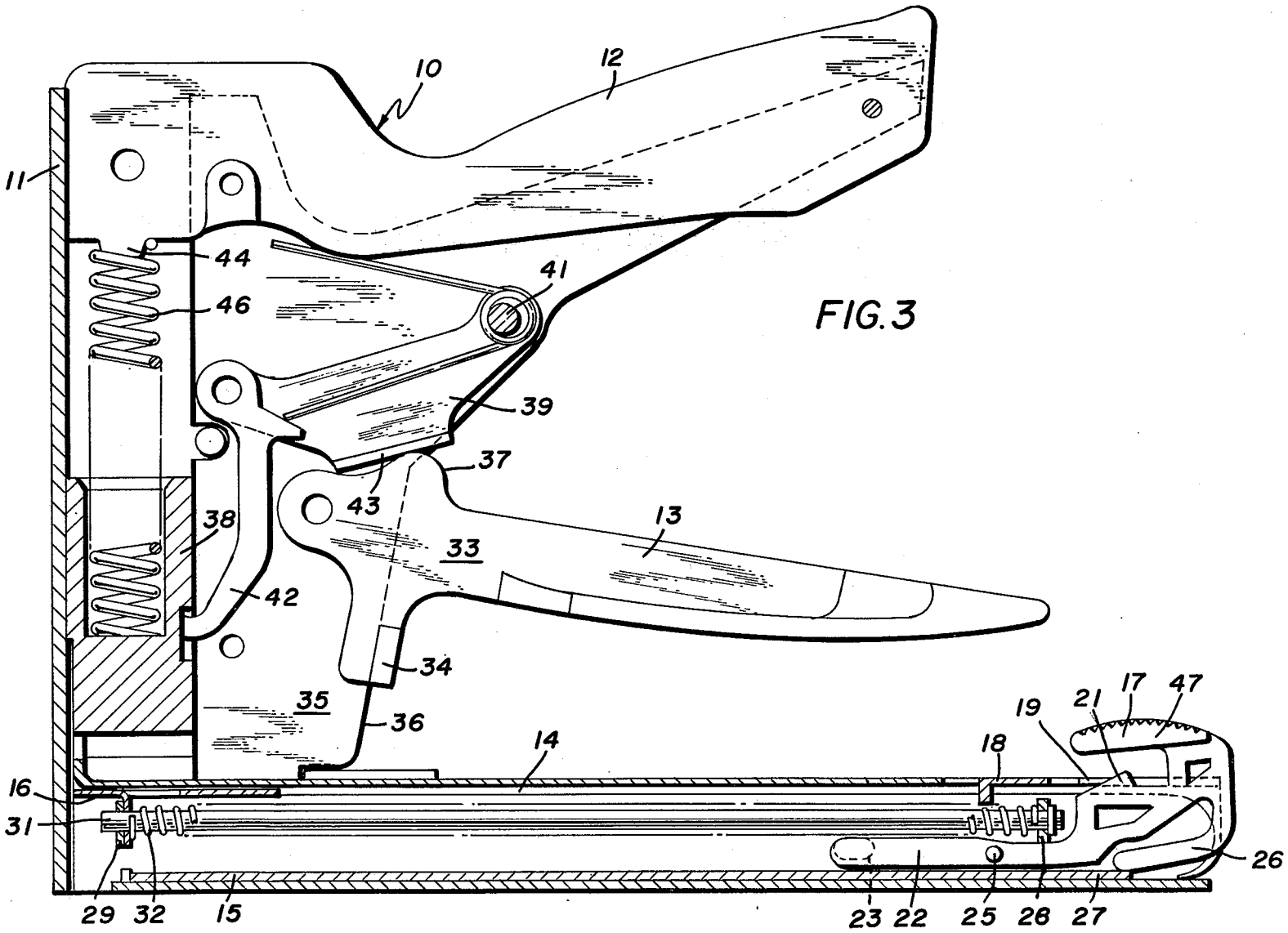
FIG. 3 is a vertical sectional view of the stapler.

Referring now to FIGS. 2 and 3, it can be seen that the compartment has an upper horizontal wall 18 with an aperture 19 formed in it. The latch has a finger 21 which normally resides in the aperture to prevent the magazine and the track from leaving the compartment. The latch also has an elongated leg 22 extending lengthwise of the staple track 15 which leg has a laterally-extending peg 23 adjacent its free end that lies in a aperture 24 formed in a side wall of the track 15. The peg 23 and its aperture 24 have the same non-circular shape and they are elongated in the direction of the length of the track 15.

A second peg 25 is integrally formed on an intermediate portion of the leg 22 of the latch 17 and extends laterally in the direction opposite that of the first-named peg 23. The second peg engages the inner surface of the adjacent wall of the staple track 15 to prevent lateral movement of the latch in the track.

The latch 17 is formed with an integral curved leaf spring 26 that engages a bottom wall 27 of the staple track 15 and biases the finger 21 upwardly into the aperture 19. The staple track has a cross brace 28 that is resiliently engaged by the leg of the latch due to the bias provided by the leaf spring 26. As is evident in FIG. 2, the staple track 15 is channel-shaped and has not only the cross brace 28 at the end adjacent the latch 17, but also another cross brace 29 located at the other end adjacent the staple driving opening. A spring-retaining rod 31 extends lengthwise of the track through central apertures in the cross braces 28 and 29. A coil spring 32 is carried on the rod with one end engaging the cross brace 28 and the other end connected to the staple pusher 16 which is slidably mounted on the track.

The operating handle 13 is injection molded from plastic and has two-spaced parallel surfaces (including the surface 33) that snugly slides between two-spaced parallel walls (including the wall 35) of the housing. The operating handle is hingedly connected by a pin 45 to the housing and has laterally-extending protuberances similar to the protuberance 34 to engage an edge (similar to the edge 36) of the wall 35 of the housing to limit the swinging motion in the downward direction. The operating handle is also formed with a smooth cam surface 37. A staple-driving hammer 38 is slidably carried in the housing, a lever 39 is swingably carried between the housing walls on a hinge pin 41, and a lifter 42 is swingably carried on the other end of the lever 39. The lifter serves to raise and release the hammer 38 (which is pressed downwardly by a spring) to drive the staple. The lever 39 is generally of U-shaped cross-section and has a connecting web or wear plate 43 for engagement by the cam surface 37 of the operating handle.

The grip handle 12 is formed of injection-molded plastic and is mounted between two spaced parallel walls of the housing 11. The handle has an integral frusto-conical protuberance 44 extending downwardly at one end. A coil spring is carried in the housing with one end of the spring engaging the hammer 38 and the other end engaging the protuberance 44 which generally holds the spring in place.

Figure 4:
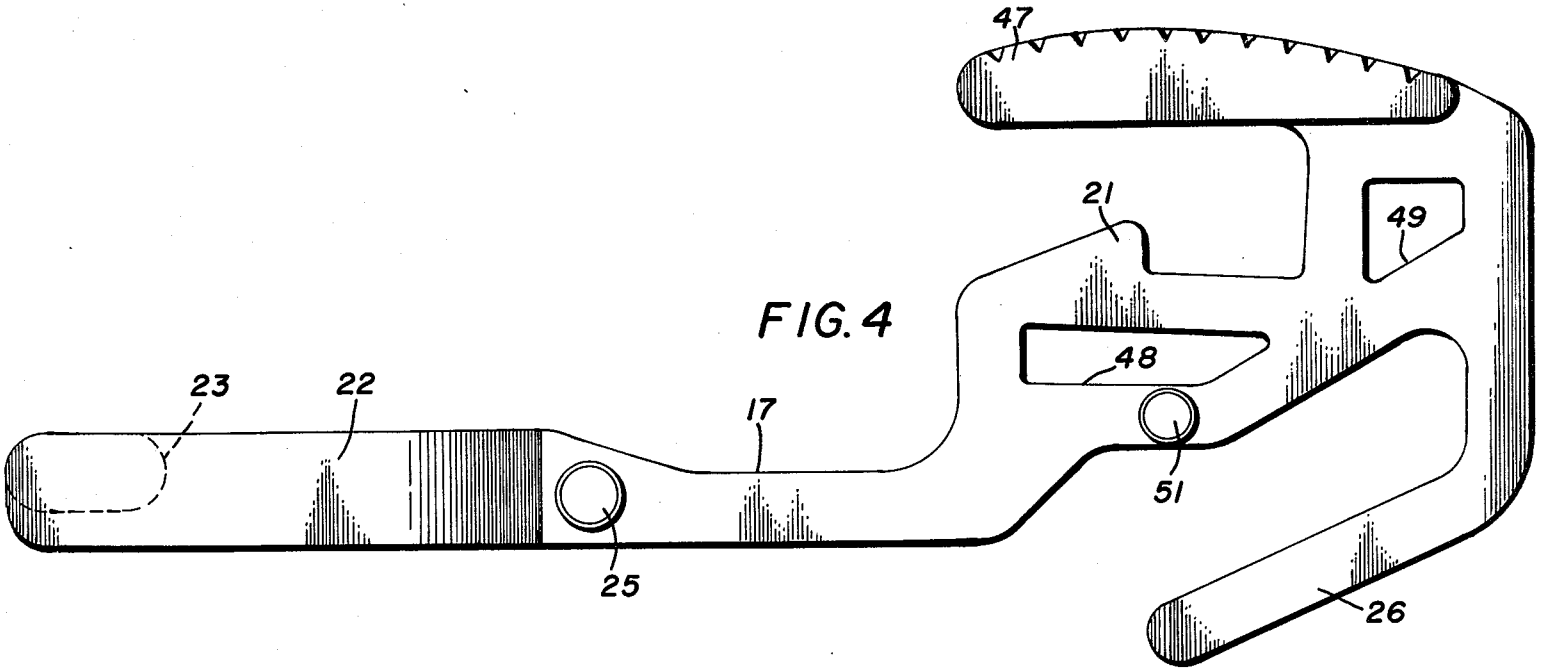
FIG. 4 is a front elevational view of a latch forming part of the invention.
Figure 5:
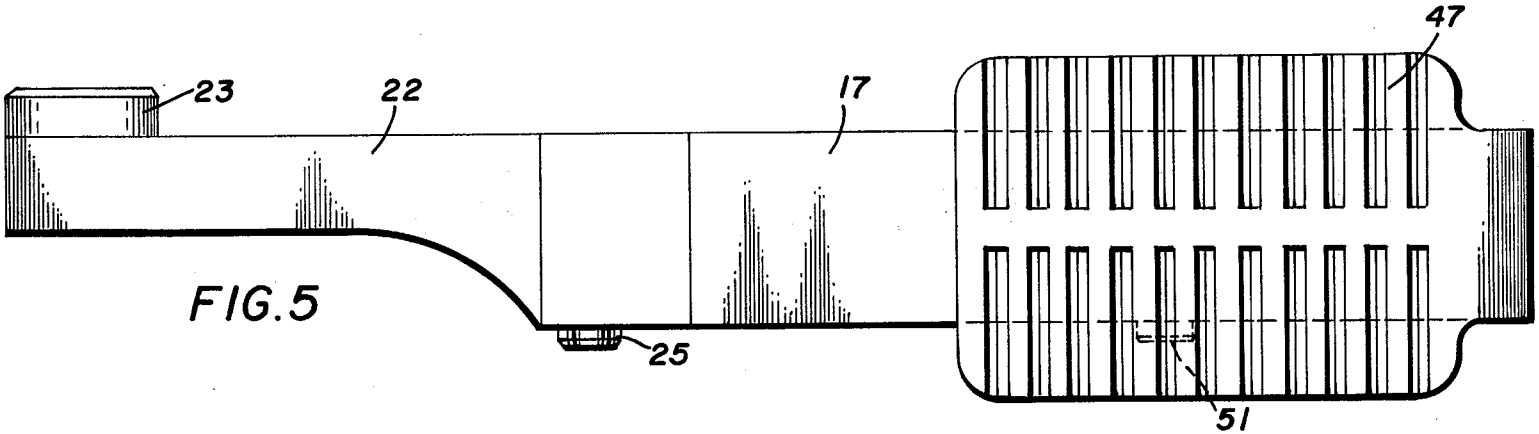
FIG. 5 is a plan view of the latch.

As is evident in FIGS. 4 and 5, the latch 17 is provided with a pressure plate 47 having a broad, curved surface which is provided with serrations. The plate extends in a cantilever fashion over the finger 21. Extending through the latch are passages 48 and 49, which not only serve to lighten the apparatus, but also increase its resilience to give the entire body of the latch a spring-like characteristic.

The operation and advantages of the present invention will now be readily understood in view of the above description. With the staple track 15 removed from the compartment, the staples are dropped over the staple track 15 and are engaged by the pusher 16 which biases them toward the driving end of the stapling gun. With the staples in place, the track is introduced to the open (right-hand) end of the compartment 14 and is pushed inwardly until it occupies the position shown in FIG. 3. As the staple track moves toward that position, the finger 21 engages the outboard edge of the top wall 18 of the compartment and, because of the sloped surface of the finger, the finger slides down under the wall and later rises again in the aperture 19. The stapler can then be operated in the usual way by placing the base or magazine against the material to be stapled and squeezing the operating handle 13 toward the grip handle 12 in the manner of operating a pistol. When it is necessary to resupply the stapler with staples, it is only necessary to press on the pressure plate 47, thus moving the latch down against the spring pressure of the leaf spring 26. Eventually, the trigger 21 will leave the aperture 19 and lie below the bottom surface of the wall 18 of the magazine, whereupon it will be possible to move the staple track outwardly. The latch 17 stays with the staple track because of the engagement of the peg 23 with its aperture 24. It is caused to remain in its aperture by the engagement of the peg 25 with the inside surface of the opposite wall of the track. In FIGS. 4 and 5 it can be seen that the outer end of the leg 22 is quite slim compared with the portion adjacent the peg 25 and lying between that position and the pressure plate 47. This gives lateral resilience to the latch, so that there is in the nature of a spring pressure between the two sides of the track 15 which tends to maintain the latch in place. In the preferred embodiment, another peg 51 in the main body of the latch serves to cause the latch to reside snugly between the two walls of the staple track 15.

The nature of the operating handle 13 is such that an integral element is provided which not only provides for limiting the downward motion by means of the protuberance 34 engaging the edge 36 of a housing wall 35, but also provides a smooth slidable cam surface 37 for engagement with the wear plate 43 associated with the lever 39. This is a simple and rugged construction capable of long wearing operation. The use of a large integral injection molding for the grip handle 12, which also serves as a cap to retain the spring 46 in place, contributes also to the simplicity and ruggedness of the construction.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A stapler, comprising:
(a) a main housing having a grip handle and an operating handle,
(b) an elongated compartment underlying the main housing and extending in the same general direction as the grip handle,
(c) a staple track slidable in and out of an opening in the compartment and having a pusher slidably mounted in the track, and
(d) a latch formed of a bendable plastic mounted in the staple track adjacent the opening in the compartment, the compartment having an upper horizontal wall having an aperture formed therein, the latch having a finger that normally resides in the aperture to prevent the track from leaving the compartment, the latch having an elongated leg extending lengthwise of the staple track and having a laterally-extending peg adjacent its free end that lies in an aperture formed in a side wall of the track.

2. A stapler as recited in claim 1, wherein a second peg is formed on an intermediate portion of the leg of the latch extending laterally in the direction opposite that of the first-named peg, the second peg engaging the inner surface of the adjacent track wall to prevent lateral movement of the latch in the track.

3. A stapler as recited in claim 1, wherein the peg and the aperture have the same non-circular shape that is elongated in the direction of the length of the track.

4. A stapler as recited in claim 1, wherein the latch is formed with an integral leaf spring that engages a bottom wall of the track and biases the finger upwardly into the aperture, and wherein the staple track has a cross brace that is resiliently engaged by the leg of the latch due to the bias provided by the leaf spring.

5. A stapler as recited in claim 1, wherein the staple track is channel shaped and has a cross brace located adjacent each end, a spring-retaining rod extending lengthwise of the track through central apertures in the cross braces, and wherein a coil spring is carried on the rod with one end engaging a cross brace and the other end connected to the staple pusher slidably mounted on the track.

6. Stapler as recited in claim 1, wherein the operating handle is formed from plastic and has two spaced parallel surfaces that snugly slide between two spaced, parallel walls of the housing, the operating handle being hingedly connected to the housing and having laterally-extending protuberances to engage an edge of the housing wall limit the swinging motion in the downward direction.

7. Stapler as recited in claim 6, wherein the operating handle is formed with a smooth cam surface, wherein a staple-driving hammer is slidably carried in the housing, wherein a lever is swingably mounted in the housing, wherein a lifter is hinged to the lever and serves to lift and release the hammer, and wherein a wear plate is formed on the lever for engagement by the cam surface.

8. Stapler as recited in claim 1, wherein the grip handle is formed of formed plastic and is mounted between two spaced parallel walls of the housing, the handle having an integral frusto-conical protuberance, wherein a staple-driving hammer is slidably mounted in the housing, and wherein a coil spring is carried in the housing, one end of the spring engaging the hammer and the other end engaging the protuberance.

* * * * *